US008360071B2

(12) United States Patent
Dorsey

(10) Patent No.: US 8,360,071 B2
(45) Date of Patent: Jan. 29, 2013

(54) COVERED ASHTRAY WITH REVERSIBLE TOP

(76) Inventor: David F. Dorsey, Scotts Valley, CA (US)

( * ) Notice: Subject to any disclaimer, the term of this patent is extended or adjusted under 35 U.S.C. 154(b) by 854 days.

(21) Appl. No.: 11/895,019

(22) Filed: Aug. 22, 2007

(65) Prior Publication Data

US 2010/0059071 A1 Mar. 11, 2010

(51) Int. Cl.
*A24F 15/08* (2006.01)

(52) U.S. Cl. ..... 131/240.1; 131/241; 131/242; 220/23.86; 220/212

(58) Field of Classification Search ..... 131/231, 131/240.1, 241, 242, 174; D27/105, 138, D27/133; 206/246; 220/212, 23.86
See application file for complete search history.

(56) References Cited

U.S. PATENT DOCUMENTS 1,851,417 A * 3/1932 Bradnack ..... 220/502
2,732,119 A * 1/1956 Risch ..... 229/406
D178,613 S * 8/1956 Nye ..... D27/133
2,786,595 A * 3/1957 Nelson ..... 220/212
4,312,346 A * 1/1982 Grigg ..... 131/231
2006/0261065 A1* 11/2006 Claypool et al. ..... 220/212

FOREIGN PATENT DOCUMENTS

JP 2002-186476 * 7/2002

OTHER PUBLICATIONS

Mechanical Online English Translation of JP 2002-186476, printed from the Internet, http://dossier1.ipdl.inpit.go.jp/AIPN/odse_top_dn.ipdl?N0000=7400, on Jun. 29, 2010.*

* cited by examiner

*Primary Examiner* — Richard Crispino
*Assistant Examiner* — Dionne Walls Mayes
(74) *Attorney, Agent, or Firm* — Michael A. Guth

(57) ABSTRACT

A covered ashtray which has a reversible top which is reversed when the ashtray is in use. The reversed side allows for the use of the ashtray in a standard fashion. Upon completion of use, the top may be placed back into the original position, wherein the ash and cigarette butts will be deposited into a chamber in the bottom portion of the ashtray.

5 Claims, 7 Drawing Sheets

COVERED ASHTRAY WITH REVERSIBLE TOP

BACKGROUND

1. Field of the Invention

This invention relates to ashtrays, and more specifically to an ashtray with a reversible top.

2. Description of Related Art

The use of ashtrays has been known in the art for countless years. Improvements to the ashtray have been made to facilitate the retention, extinguishing, and disposal of cigarettes. While such designs have been developed, there have nevertheless been a plurality of drawbacks associated with prior designs.

It is well known that smoking outdoors or in public areas can create adverse and often hazardous effects, including the possibility of the cigarette butts becoming the cause of a fire. In addition, smoking indoors and using conventional ashtrays can result in there being an undesirable view of an ashtray filled with cigarette butts and also result in there being the unpleasant smell resulting therefrom.

What is called for is an ashtray that allows for the concealment of the smoking debris when the ashtray is not in use. What is also called for is an ashtray that can greatly reduce the fire risk from cigarette butts. What is also called for is an ashtray that does not appear to be an ashtray when not in use.

SUMMARY

A covered ashtray which has a reversible top which is reversed when the ashtray is in use. The reversed side allows for the use of the ashtray in a standard fashion. Upon completion of use, the top may be placed back into the original position, wherein the ash and cigarette butts will be deposited into a chamber in the bottom portion of the ashtray.

DETAILED DESCRIPTION

Figure 1:
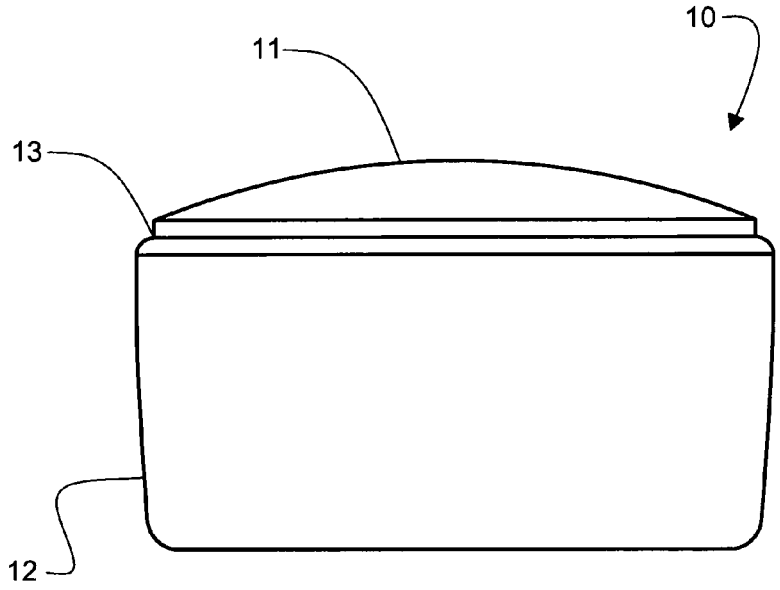
FIG. 1 is a side view of a covered ashtray according to some embodiments of the present invention.
Figure 2:
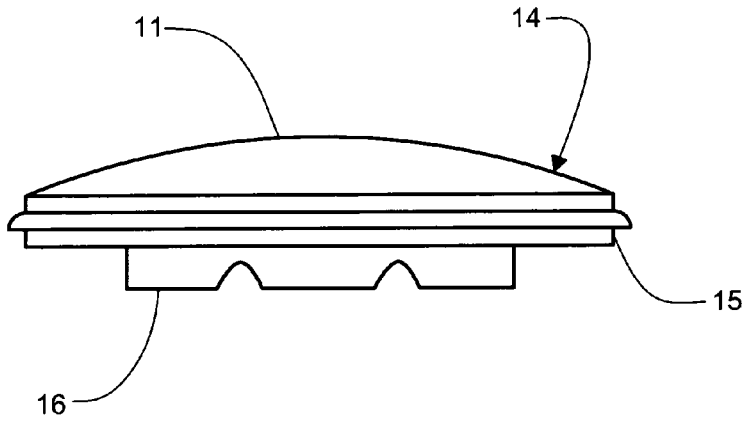
FIG. 2 is a side view of an ashtray top piece according to some embodiments of the present invention.

In some embodiments of the present invention, as seen in FIGS. 1 and 2, a covered ashtray 10 has a top portion 11 and a base 12. The top surface 14 of the top portion 11 may be curved, and may be in the shape of a partial sphere in some embodiments. The top portion 11 is adapted to reside atop the base 12. The top portion 11 is adapted to be easily removable from the base 12. In some embodiments, the ashtray 10 may be made of a heavy material such as brass.

Figure 3:
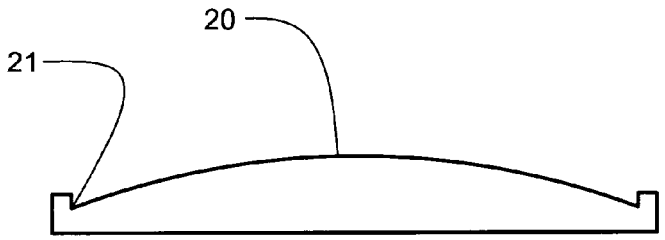
FIG. 3 is a partial cutaway view of an ashtray top piece according to some embodiments of the present invention.

The top portion 11 of the ashtray 10 has a recessed lower rim 15 adapted to fit snugly within the interior dimension of the base 12, thereby centrally positioning the top portion 11 within the ashtray 10. The top portion 11 is adapted to be reversed for use when smoking. The top portion 11 may be easily lifted up and flipped over by the user. The top surface 14 of the top portion 11 becomes the bottom in this circumstance, and the top portion may have a top recess 13 allowing for the same type of centrally positioned fit as was seen with the lower recess on the bottom of the top portion. FIG. 3 shows a profile of an alternative top portion wherein the top surface 20 is recessed relative to the rim 21, also allowing for a centrally positioned fit, with the rim residing around the outer rim of the base 12.

Figure 4:
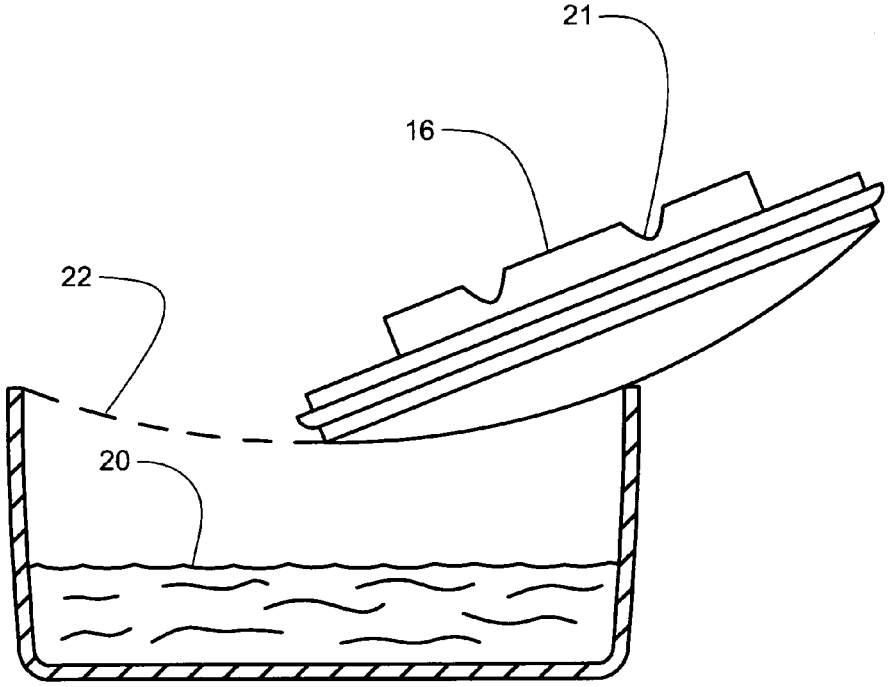
FIG. 4 is a partial cutaway side view of a covered ashtray according to some embodiments of the present invention.
Figure 5:
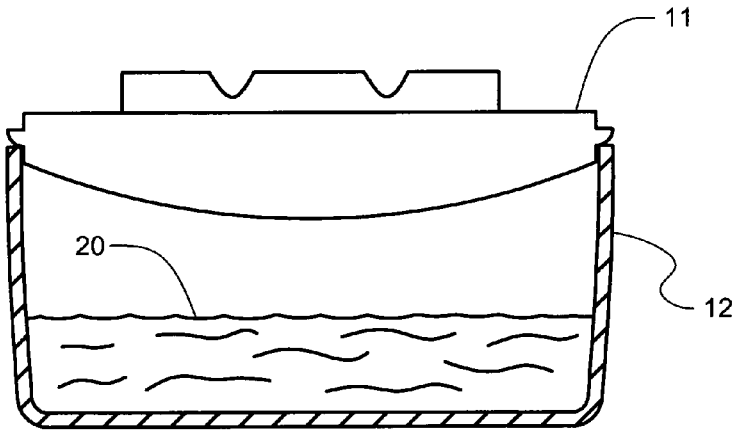
FIG. 5 is a partial cutaway side view of a covered ashtray according to some embodiments of the present invention.

FIGS. 4 and 5 illustrate an aspect of the use of the ashtray 10. FIG. 4 illustrates the top portion 11 as it is being slid into position onto the base 12. Partial arc 22 illustrates the path that the top portion 11 will take, as well as the arc of furthest penetration that the top portion will take into the well of the base 12. A preferred situation is wherein the arc of penetration, which penetrates a distance very close to the depth of the arc of top surface 14 of the top portion 11, does not penetrate into the well of the base 12 far enough to interfere with the residue 20 that may build up in the base during normal use, in between the times when the user empties the base 12. For example, there may be an inch or more of depth in the well of the base 12 to allow for this buildup, so that the top portion does not pick up or disturb this residue when being slid into place.

In some embodiments, the top portion 11 will have sufficient weight to help the top portion slide fully into the smoking position, as seen in FIG. 5. A relatively smooth top surface coupled with the mass of using a relatively dense metal, such as brass, helps enable the top portion 11 slide down into the centrally positioned location. The insert 16 is adapted to allow the user to place a cigarette in slot 21 while it rests upon the inner rim of the top portion. Ashes can be placed into the center of the insert, and the cigarette can be stamped out in the center of the insert as well.

Upon completion of smoking, the user may turn over the top portion and dump the debris into the well of the base 12. The top portion may then be replaced onto the base with its curved side 14 facing upwards. This setup has numerous advantages. The smoking debris and ash is covered over in the well of the base after completion of smoking. This greatly reduces the likelihood of accidentally starting a fire. For example, if used outside, the fact that the ashes and butts are inside a covered well minimizes the possibility that a breeze may flame up a cigarette butt that was not fully extinguished. A similar addition of safety occurs inside the home.

Further, the fact that one may cover the smoking debris greatly reduces the amount of odor that the ashtray will cause after the completion of smoking. Another distinct advantage is that the user may have this ashtray on a coffee table or side table and it simply will not appear to be an ashtray. As smoking has to some extent fallen out of favor in polite society, the ability to camouflage an ashtray may fit the needs of some users. In addition, the top surface 14 of the top portion 11 may be embossed or otherwise decorated such that the closed ashtray has the appearance of a knick knack container or the like.

Figure 6:
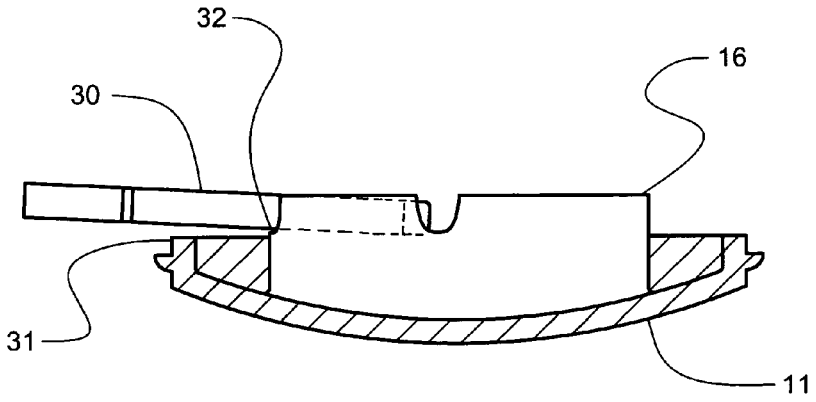
FIG. 6 is a partial cutaway view of a top portion according to some embodiments of the present invention.

FIG. 6 illustrates a partial cross section of a top portion 11 as it would be in use while residing atop the base 12. The raised lip 16 with its slots 21 have one of the slots occupied by a cigarette 30. In some embodiments, the raised lip 16 will be define a hollow space or well within such that there is sufficient space at least for the ashes and butts of one or two cigarettes. The height 32 of the base of the slots 21 relative to the height 31 of the interior of the top portion is preferred to be relatively equal such that the lit end of the cigarette is not pointed down and placed too deeply into the hollow space within the insert, in order to avoid relighting discarded butts and the like, but still is in a position that it will not likely fall out.

Figure 7:
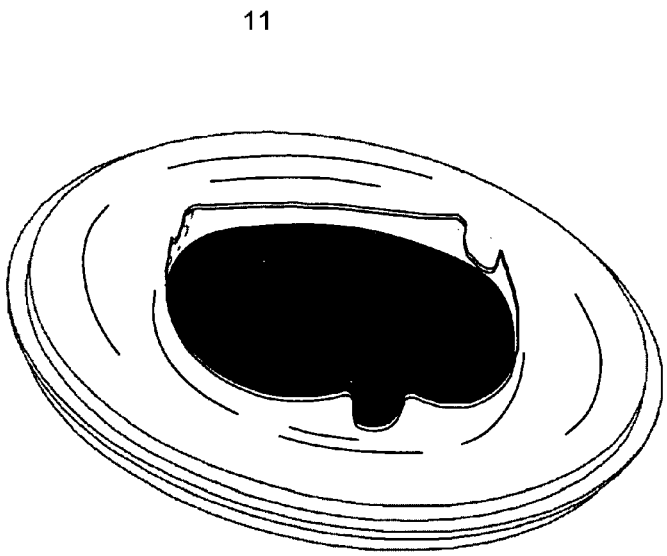
FIG. 7 is a perspective view of a top portion according to some embodiments of the present invention.

FIG. 7 illustrates a top portion 11 with a raised lip 16 according to some embodiments of the present invention.

As evident from the above description, a wide variety of embodiments may be configured from the description given herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

I claim:

1. An ashtray comprising:

a base, said base comprising:

a side portion;

a bottom portion; and a top rim around the top edge of said side portion, wherein said side portion and said bottom portion define a well within said side portion and above said bottom portion; and a reversible top portion, said reversible top portion comprising:

a top, and a bottom, wherein said bottom comprises a raised lip surrounding a well area, wherein said raised lip has depressions adapted for holding cigarettes;

a recessed bottom rim along the periphery of said bottom of said reversible top portion, said recessed bottom rim adapted to fit within the inside rim of said top of said base;

a recessed top rim along the periphery of said top of said reversible top portion, said recessed top rim adapted to fit within the inside of said top rim of said base, said reversible top portion easily removable from said base, wherein said top of said reversible top portion comprises a continuous surface extending across the entirety of said top of said reversible top portion.

2. The ashtray of claim 1 wherein said top rim of said base is circular.

3. The ashtray of claim 1 wherein said top of said top portion has a curved cross section.

4. The ashtray of claim 1 wherein said ashtray comprises metal.

5. The ashtray of claim 4 wherein said ashtray comprises brass.

* * * * *